US007475585B1

(12) United States Patent
Lill et al.

(10) Patent No.: US 7,475,585 B1
(45) Date of Patent: Jan. 13, 2009

(54) PUNCH TOOL FOR SECURITY PURPOSES

(75) Inventors: Clifford F. Lill, Hawthorne, NJ (US); Kristopher J. Lill, Oakland, NJ (US)

(73) Assignee: Royalty Holding LLC, Hawthorne, NJ (US), by said Clifford F. Lill ( * ) Notice: Subject to any disclaimer, the term of this patent is extended or adjusted under 35 U.S.C. 154(b) by 333 days.

(21) Appl. No.: 11/418,516

(22) Filed: May 4, 2006

Related U.S. Application Data

(63) Continuation-in-part of application No. 11/253,893, filed on Oct. 19, 2005, now Pat. No. 7,128,495.

(51) Int. Cl.
*B21D 15/10* (2006.01)

(52) U.S. Cl. ..... 72/466.4

(58) Field of Classification Search ..... 72/466.6, 72/466, 465.1, 466.4, 466.5; 81/23, 451, 81/452, 453; 411/377
See application file for complete search history.

(56) References Cited

U.S. PATENT DOCUMENTS

| | | | | | |
|---|---|---|---|---|---|
| 362,224 | A * | 5/1887 | Newman | ..... | 81/23 |
| 903,095 | A * | 11/1908 | Johnson | ..... | 81/23 |
| 1,296,165 | A * | 3/1919 | Costuma | ..... | 411/406 |
| 1,333,437 | A * | 3/1920 | Monroe | ..... | 81/451 |
| 1,562,543 | A * | 11/1925 | Cox | ..... | 81/453 |
| 3,065,662 | A * | 11/1962 | Spoehr et al. | ..... | 411/399 |
| 5,950,777 | A * | 9/1999 | Stafford | ..... | 188/319.2 |
| 6,634,842 | B2 * | 10/2003 | Ueno | ..... | 411/377 |
| 7,128,495 | B1 * | 10/2006 | Lill et al. | ..... | 404/4 |

* cited by examiner

*Primary Examiner*—Dana Ross
*Assistant Examiner*—Teresa Bonk
(74) *Attorney, Agent, or Firm*—W. Patrick Quast

(57) ABSTRACT

A security slug punch tool is disclosed. A typical application includes protecting curb box cover assemblies employed on catch basins along thoroughfares. The hand held tool houses a first cylinder extending beyond one end of the tool affixed to a smaller diameter cylinder drive pin. A deformable slug is secured within an elastomeric grommet at one end of the tool. An operator forcibly striking the first cylinder causes the slug to be wedged into a face opening in a bolt head, as, for example, a hexagonal opening in a bolt securing a curb box cover assembly, thereby rendering the bolt tamper proof. The punch tool and slug can be configured for securing a variety of bolts with different face openings.

12 Claims, 5 Drawing Sheets

PUNCH TOOL FOR SECURITY PURPOSES

This is a continuation-in-part of our prior application Ser. No. 11/253,893, titled "Curb Box Cover Assembly", filed Oct. 19, 2005 now U.S. Pat. No. 7,128,495, which application is herein incorporated by this reference.

This invention relates to devices and methods for the prevention of unauthorized removal of bolts from generally available structures, and in particular to loosening and/or removal of catch basin cover assemblies along public thoroughfares.

BACKGROUND OF THE INVENTION

In the above noted co-pending prior application, applicants have described a catch basin curb box cover assembly including an improved securing clamping means. As is a common problem with a myriad variety of public structures, these catch basin curb box cover assemblies, together with their unique clamps, can offer an attraction to vandals or pilferers to loosen, remove, or outright steal these structures. To prevent this expensive and destructive behavior a tool has been devised to eliminate or at least seriously discourage this unfortunate activity.

It is therefore a primary object of the present invention to prevent unauthorized removal of bolts from public structures.

An additional object is to provide a simple, hand held tool for protecting bolts from unauthorized removal.

Yet another object is to provide a tool for protecting bolts from unauthorized removal, said tool having a front end configured to conform to an exposed face portion of a bolt.

Still another object of the invention is to provide a tool for wedging a slug into an opening in the face portion of a bolt so as to protect said bolt from unauthorized removal.

A further object is to provide a tool for protecting bolts securing public structures after said structures have been secured in place.

SUMMARY OF THE INVENTION

These and other objects are obtained with the security slug punch tool of the invention.

As noted in our said above mentioned co-pending application a catch basin curb box cover assembly with securing clamps is described. This prior invention provides variously configured curb box cover assemblies for attachment to existing catch basins along the length of thoroughfares in developed areas. A specially designed securing clamping means is employed for confidently securing the cover assembly to the catch basin even against the irregular, angled interior surface of most catch basin castings. Both the covering member and these unique clamps can prove attractive to vandals and others which can result in these structures and components being dangerously loosened, or even completely removed.

It occurred that if the bolt employed to secure the clamping means for the covering member was rendered tamper proof, then loosening the bolt so as to damage or remove the covering member would be prevented. To this end a hand held tool has been devised to accomplish this purpose.

In a preferred embodiment of the above noted clamping means a pair of co-axially aligned and integrally connected catch basin contact members pivotally mounted on a clamp member are caused to secure a covering member to a catch basin by means of an operator's action of threading a bolt through a cooperating threaded opening in said pivot member. The head of the bolt is positioned external to the covering member, with clamping means catch basin contact members being positioned behind and within the covering member and opening to the catch basin. In this case an opening in the bolt head contains a standard hexagonal slot, enabling the operator to employ an Allen wrench to turn the bolt head and thereby secure the covering member to the catch basin, with the clamp member secured within the catch basin, but the bolt head clearly visible and accessible on the exterior of the cover assembly now affixed to the catch basin.

In this configuration the cover assembly is now vulnerable to mischievous and harmful activity. A punch tool is now employed to prevent such actions. The purpose of the punch tool is to provide the means for securing a slug within the opening in the face of the bolt. This is accomplished with the security slug punch tool of the invention.

The punch tool can be fabricated out of various materials, including metals and rigid plastic, with steel being preferred. A steel cylinder sized for comfortable hand holding contains a first large diameter bore in reference to a second smaller diameter bore throughout its length. A cylindrically shaped force transmitter is configured to slip fit within the two bores, with a large diameter portion of the force transmitter extending beyond a first end of the tool. A second end of the tool is configured in a tapered concave shape matching the head of the clamp securing bolt. A rubber grommet securing a metal slug is affixed at the base of this concave shaped second tool end.

In operation the second end of the punch tool is placed over the head of the bolt after the bolt has secured the covering member to the catch basin. A hammer of other suitable tool is used to strike the extended end of the force transmitter, causing the drive pin on the force transmitter to slide a spaced distance beyond the concave base portion at the second end of the punch tool with sufficient force so as to cause the slug positioned in the rubber grommet to be wedged into the hexagonal opening in the head of the bolt. The bolt is now permanently protected from being opened by persons unauthorized to do so.

The security slug punch tool of the invention can, of course, be configured for a virtually limitless variety of openings in addition to the above described hexagonal slot for standard Allen wrench operation.

DETAILED DESCRIPTION OF THE PREFERRED EMBODIMENTS

Figure 1:
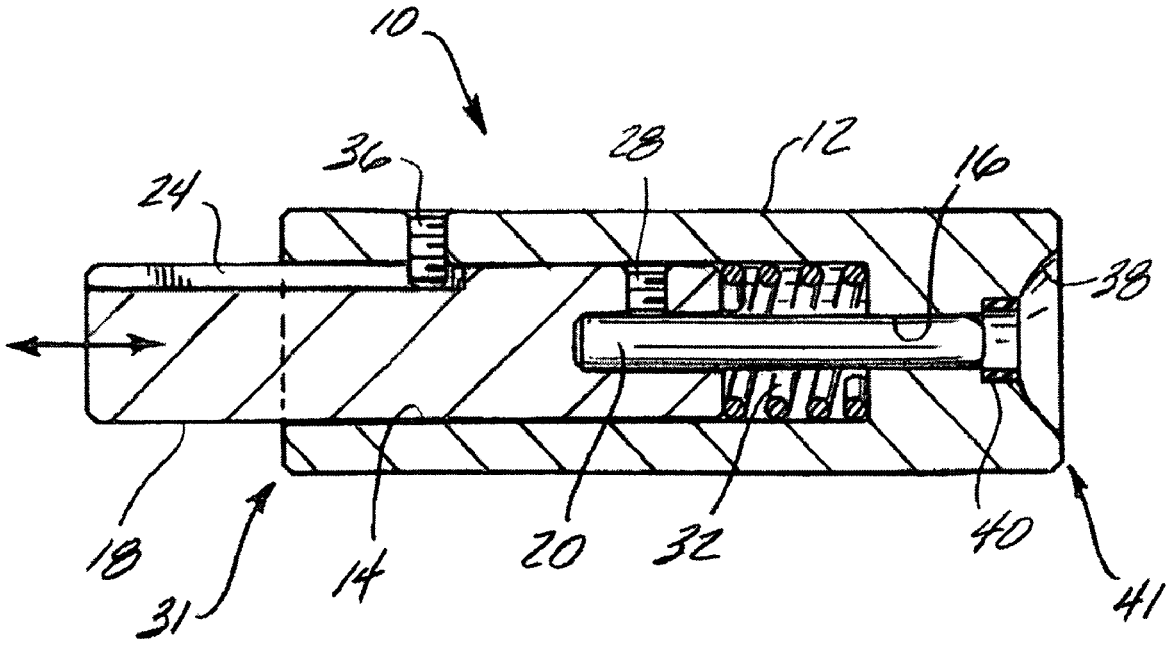
FIG. 1 is a perspective, schematic view of one version of the security slug punch tool of the invention, illustrating the interior placement of component parts with the tool at rest.

Turning now to the drawings wherein similar structures having the same function are denoted with the same numerals, in FIG. 1 a version 10 of the security slug punch tool is illustrated. The punch tool 10 of the present invention can be fabricated in a variety of shapes, with a cylindrical shape being preferred. Material of construction can include rigid plastic, with metals such as steel preferable for durability. An outer barrel 12 houses a first cylinder, hereinafter referred to as a force transmitter 18, with an attached smaller diameter cylinder, hereinafter referred to as a drive pin 20.

Figure 2:
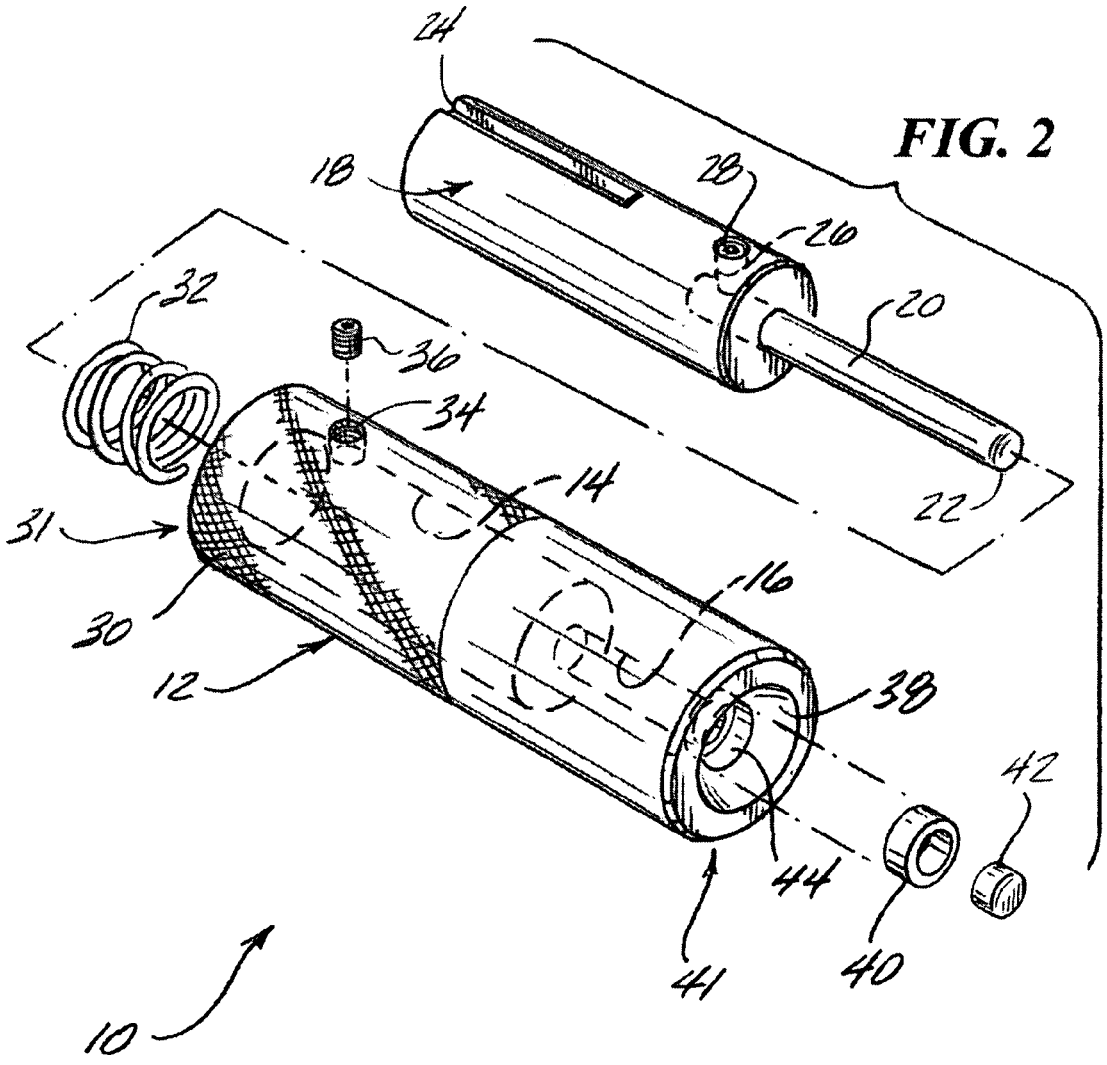
FIG. 2 is an exploded, schematic view of one version of the security slug punch tool of the invention, similar to that depicted in FIG. 1.

As best seen in FIG. 2, the barrel 12 contains a large bore 14 extending from a first end 31 approximately three quarters of the length of the barrel, with a narrower co-axially positioned second bore 16 extending from said first bore to a second end 41 of the barrel. Approximate dimensions of the barrel can be, for example, 4" in length×1⅛" in width, the first bore diameter being ¾", the second bore diameter being ¼". An approximate 1" long×¾" diameter steel spring 32 is fitted within the first bore 14 of the barrel. Approximately half of the external surface of the barrel can be knurled 30 for added convenience while handling.

The force transmitter 18 and attached drive pin 20 are also preferably fabricated in steel. The force transmitter can be approximately 3" in length, with a diameter slightly less than that of the barrel first bore 14. A linear slot 24 on the surface of the force transmitter extends from a first end for approximately half its length. The drive pin 20 can be approximately 2" in length, with a ¼" diameter. The drive pin extends a spaced distance within a matching approximate ¼" bore within and at a second end of the force transmitter, then extends beyond this second end of the force transmitter. This extension of the drive pin from the second end of the force transmitter will in operation be an extension within the second bore 16 of the barrel to a point just before an opening 44 at the second end 41 of the barrel. The drive pin is replaceably secured to the force transmitter by means of a threaded hole 26 and set screw 28 adjacent the second end of the force transmitter, being positioned perpendicular to the axis of the first bore 14 of the barrel.

After the spring 32 is secured within the barrel 12 the force transmitter 18 and attached drive pin 20 are slipped within the first 14 and second 16 bores in the barrel, being secured in operative position by means of a threaded hole 34 and set screw 36 adjacent the first end of the barrel, being positioned perpendicular to the axis of the first bore of the barrel. The set screw 36 is dimensioned so as to fit within the linear slot 24 on the surface of the force transmitter adjacent a perpendicular walled end of the linear slot so as to form a pre-determined stop for the force transmitter and drive pin within the barrel. In this now operative position the force transmitter now extends a spaced distance beyond the first end of the barrel, with the head 22 of the drive pin positioned adjacent the opening 44 at the second end of the barrel.

The second end 41 of the barrel has an approximate ½" tapered opening so as to conform to the head of a bolt 76 (FIG. 4) as will be more fully explained below. The opening 44 at the second end of the barrel is configured to accept an elastomeric grommet 40. The grommet is selected so as to accept a deformable slug 42 within its center opening. The slug can be, for example, a mild 10-18 steel softer than that used to fabricate the bolt 74. Dimensions of the slug can be approximately 3/16" in width×0.312" in diameter. With the grommet affixed to the aperture 44 at the second end of the barrel, and with the slug 42 secured within the opening in the grommet, the security slug punch tool 10 of the invention is now ready for operation.

Figure 3:
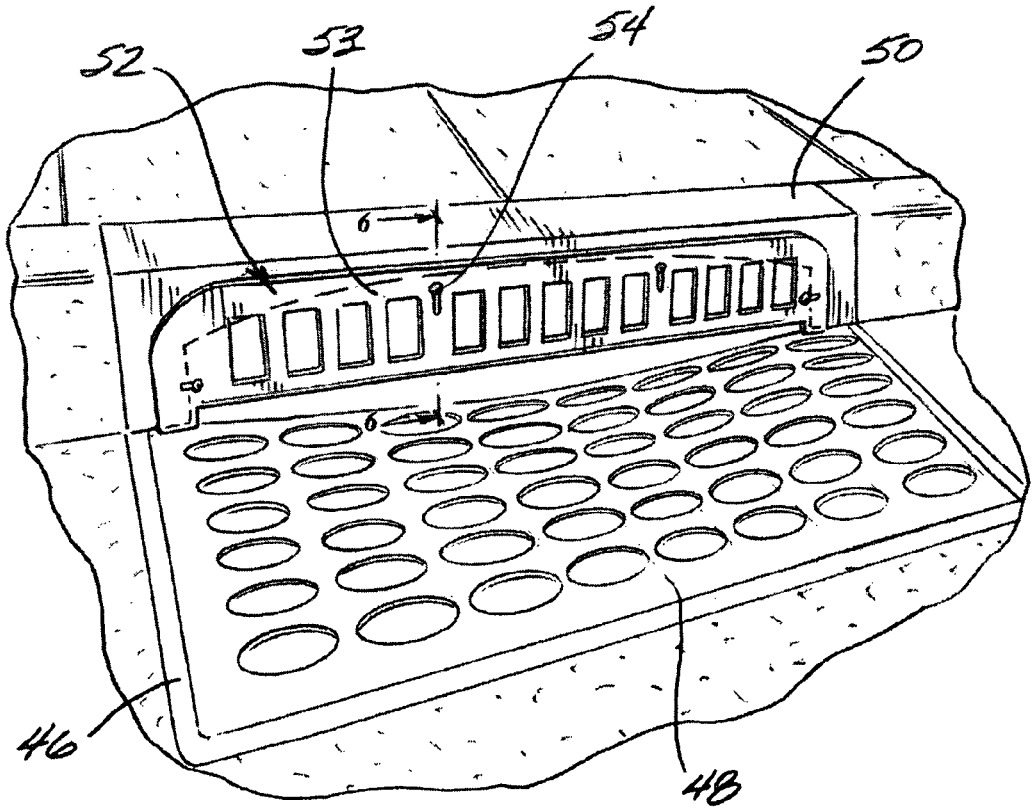
FIG. 3 is a perspective view of a catch basin curb box with a cover assembly installed.

As noted above, our co-pending application Ser. No. 11/253,893, filed Oct. 19, 2005 for a "Curb Box Cover Assembly" describes a typical application for the punch tool 10 of the invention. FIG. 3 illustrates one type of cover assembly 52 as secured to a catch basin. The catch basin is comprised of a catch basin frame 46 securing a street gate 48, with a curb piece portion 50 of the catch basin.

Figure 4:
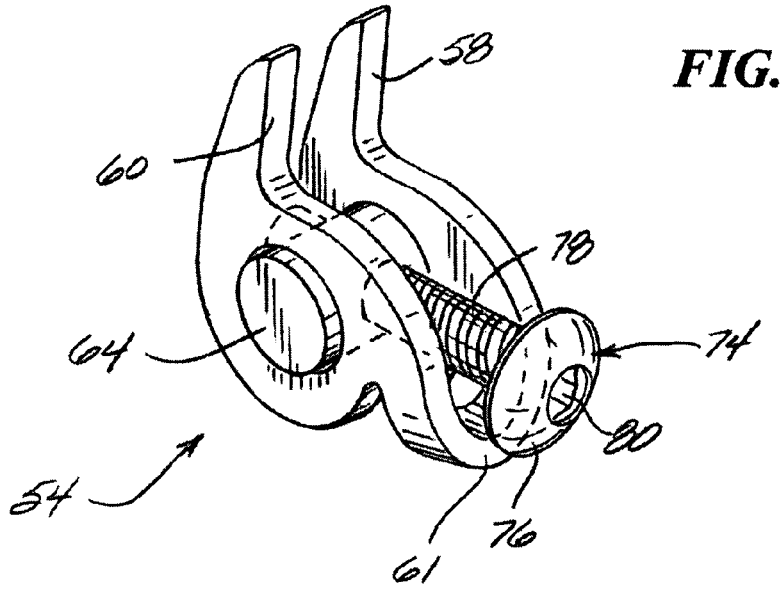
FIG. 4 is a perspective view of the means for clamping the covering member, showing the assembled relationship of the components.
Figure 5:
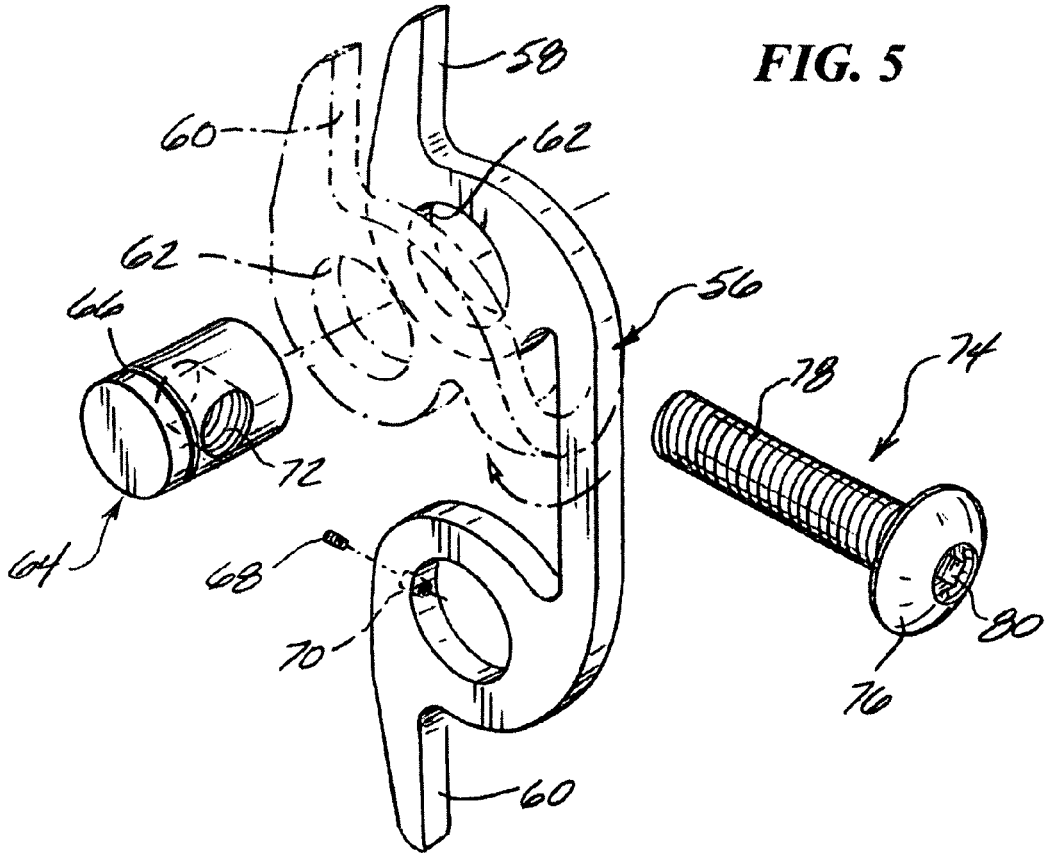
FIG. 5 is an exploded view of the means for clamping the covering member.

As best seen in FIGS. 4 and 5, unique clamping means 54 are employed to securely affix the cover member 53 to the catch basin. Clamping means 54 is formed by bending a transition member 56 so that openings 62 in a first catch basin contact member 58 and a second catch basin contact member 60 are axially aligned. A pivot member 64 is secured within the catch basin contact member openings 62 by means of a circumferential groove 66 at one end of the pivot member and a cooperating threaded hole 70 and set screw 68 in second catch basin contact member 60 making contact between opening 62 and groove 66. A threaded hole 72 within the pivot member is then accessed by matching threads on the shank 78 of the bolt 74.

Figure 6:
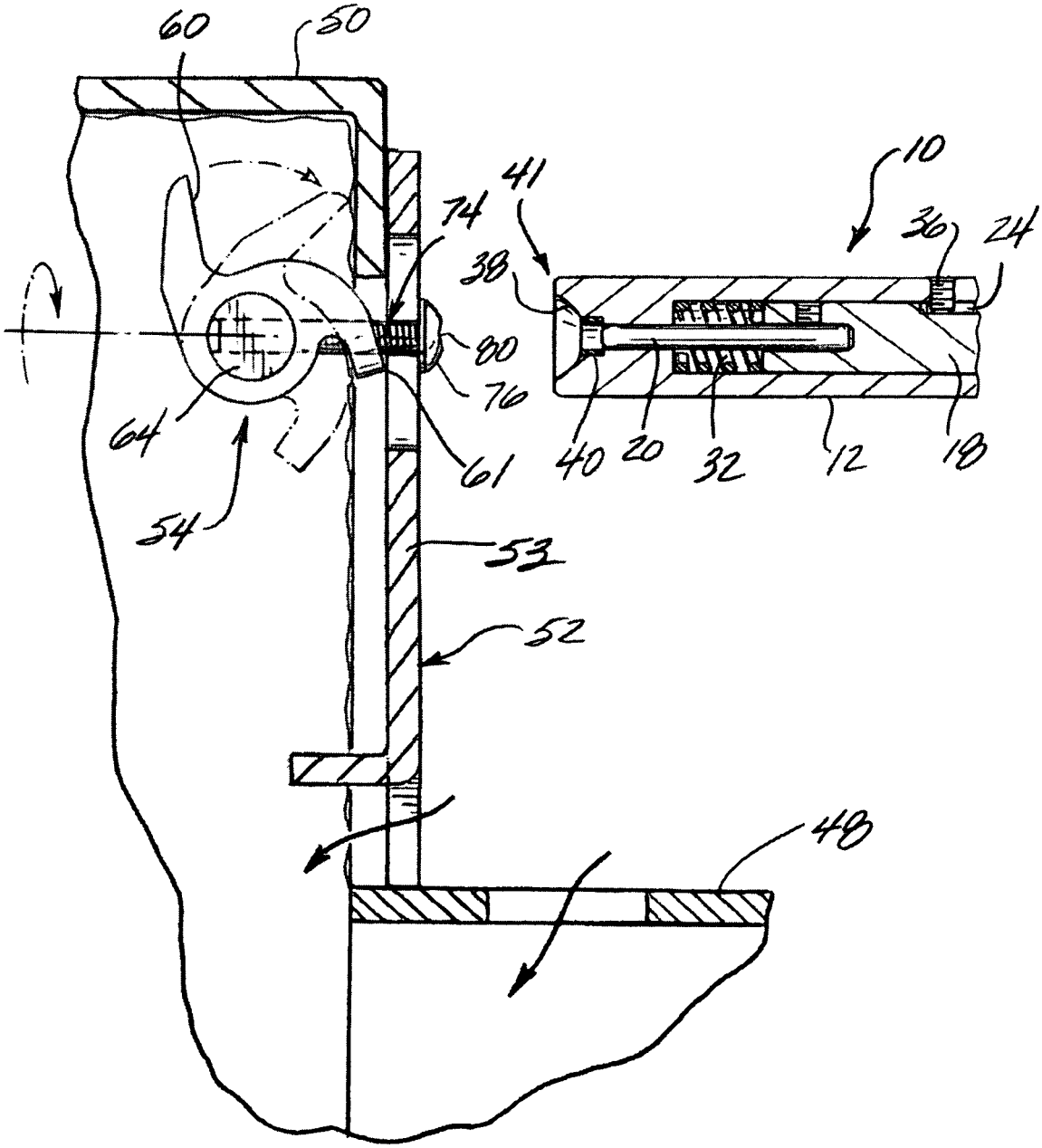
FIG. 6 is a side elevation view taken along lines 6-6 in FIG. 3 showing the covering member in place in front of the catch basin, and showing a version of the invention about to render the bolt tamper proof.

FIG. 6 illustrates the bolt 74 in clamping means 54 about to be tightened to affix the cover member 53 to the curb piece portion of the catch basin with the punch tool 10 ready to render the bolt tamper proof. A cover member contact member 61 of the transition member 56 is shown in contact with an inner face of the cover assembly with the bolt about to be tightened (using, for example, an Allen wrench[not shown]) so as to swing first catch basin contact member 58 (not shown) and second catch basin contact member 60 into contact with an inner face portion of the curb piece portion of the catch basin, thereby securing the cover assembly 52 to the catch basin. After the bolt is finished securing the clamp member 54, the tapered opening 38 at the second end 41 of the punch tool, which has been pre-configured so as to match opposing contours on the tapered head 76 of the bolt, is secured over the bolt head by an operator. The operator then can take a hammer or similar tool and strike the end of the force transmitter extending beyond the first end of the barrel. This action will cause the force transmitter to compress the spring 32 within the first bore 14 of the barrel and move the drive pin forward, dislodging the slug 42 from the grommet 40 and into the opening 80 in the bolt head. The head 22 of the drive pin is slightly rounded so as to facilitate dislodging of the slug from the grommet. The "softer" metal of the slug material flows sufficiently to fill the opening 80 in the bolt head, and is generally flush to the surface of the bolt head after the operation is complete. The compressed spring will now relax and push the force transmitter back to the pre-determined position within the barrel as determined by the slot 24 contacting the barrel mounted set screw 36. The operator now simply places another slug into the grommet and proceeds to protect as many bolts as deemed necessary.

Thus it can be seen that public structures attractive to vandals and other unauthorized individuals can be simply and economically fastener protected. A security slug punch tool is disclosed providing means for rendering tool tightening and loosening head openings of bolts tamper proof. A quick hammer strike on the hand held tool dislodges a pre-formed slug into the fastener head opening, permanently preventing future loosening.

While the present invention has been disclosed in connection with versions shown in detail, various modifications and improvements will become readily apparent to those skilled in the art. Accordingly, the spirit and scope of the present invention is to be limited only by the following claims.

What is claimed is:

1. A security slug punch tool, comprising:

(a) an elongated body of a certain length housing a large bore beginning at a first end of said body and ending at a point along the length of said body, and a smaller bore in reference to said large bore co-axially positioned with, and extending from said large bore to a second end of said body along a first axis;

(b) spring means being positioned within said body at said ending of said large bore;

(c) a slug made from deformable material;

(d) means for releasably retaining said deformable slug at said second end of said body, said means for releasably retaining including means for coaxially aligning said slug along said first axis, said second end of said body having an interior surface contoured so as to engage a head portion of a bolt having a second axis and a head opening coaxially disposed about said second axis; and (e) a force transmitter including a drive pin assembly, said force transmitter being shaped and configured for placement within said large bore in said body, and said drive pin shaped and configured for placement within said smaller bore in said body such that said drive pin is coaxially aligned with said first axis, said force transmitter and said drive pin being positioned within said body so that one end of said force transmitter extends a spaced distance from said first end of said body with the other end of said force transmitter being positioned adjacent said spring means, said drive pin extending within said smaller bore of said body from said end of said force transmitter adjacent said spring means ending at a position adjacent said means for releasably retaining said deformable slug, so that when said deformable slug is retained within said deformable slug releasably retaining means, and when an operator engages said contoured end of said second end of said body with the head portion of the bolt, said first axis is substantially aligned with said second axis, such that when said operator strikes said end of said force transmitter extending from said first end of said body, said force transmitter and said drive pin are caused to be moved forward in said body, and said end of said drive pin adjacent said means for releasably retaining said deformable slug is caused to force said deformable slug to be released from said means for releasably retaining into said opening in said bolt head, thereby causing said deformable slug to be wedged within said opening in said head of said bolt.

2. The security slug punch tool according to claim 1 wherein said means for releasably retaining said deformable slug comprise an elastomeric grommet fitted within an aperture at said second end of said body.

3. The security slug punch tool according to claim 1 wherein said slug is fabricated in a softer material than said head of said bolt.

4. The security slug punch tool according to claim 1 wherein said force transmitter contains a slot extending from said end of said force transmitter adjacent said first end of said body a linear spaced distance along a length of said force transmitter, said slot cooperating with a body threaded hole and a body set screw within said body being positioned perpendicular to said axis of said large bore within said body and being adjacent said first end of said body, said body set screw extending through said body threaded hole and into said slot, said body set screw forming a pre-determined stop for said force transmitter within said body.

5. The security slug punch tool according to claim 1 wherein said force transmitter and said drive pin are separate pieces having means for being affixed together.

6. The security slug punch tool according to claim 5 wherein said affixing means comprise a linear hole extending a spaced distance within said end of said force transmitter adjacent said spring means a cooperating force transmitter threaded hole and force transmitter set screw, said force transmitter threaded hole being positioned perpendicular to said axis of said first bore in said body and being in contact with said linear hole within said end of said force transmitter, an end of said drive pin being positioned within said linear hole within said end of said force transmitter, said drive pin being secured in position by said force transmitter set screw in said force transmitter threaded hole.

7. The security slug punch tool according to claim 1 wherein said body is fabricated in steel.

8. The security slug punch tool according to claim 1 wherein said force transmitter and said drive pin are fabricated in steel.

9. The security slug punch tool according to claim 1 wherein a portion of the outer surface of said body is knurled to facilitate handling.

10. A method for preventing unauthorized removal of bolts securing structures, comprising the steps of:

(a) using at least one bolt to secure said structure;

(b) forming a hand held tool, said tool having a cylindrical large bore and a confluent cylindrical small bore throughout its length for accommodating a force transmitter and confluent drive pin configured for slidable operation within said tool;

(c) contouring an interior surface of a first end of said tool so as to conform to a shape of a head of said bolt;

(d) placing said force transmitter and confluent drive pin within said tool so that a free end of said force transmitter extends beyond said tool, and a free end of said drive pin is adjacent said tapered end of said tool;

(e) securing a deformable slug within said first end of said tool;

(f) placing said first end of said tool over said head of said bolt; and (g) having an operator strike said free end of said force transmitter with a hammer, thereby causing said force transmitter and confluent drive pin to slide forward within said tool and cause said free end of said drive pin to wedge said deformable slug within an opening in said head of said bolt.

11. The method according to claim 10 wherein said structure is a cover member for a catch basin curb box, further comprising the steps of:

(a) placing at least one clamping member within said catch basin curb box prior to said step of using said at least one bolt; and (b) using said at least one bolt to cause said at least one clamp member to secure said cover member to said catch basin curb box.

12. The method according to claim 11 wherein said clamping member comprises two juxtaposed and aligned catch basin contact members confluent with a cover member contact member, said clamping member being rotationally mounted on a pivot member about a first axis, said pivot member having a threaded opening for accepting a matching threaded shank portion of said bolt, said head of said bolt being positioned external to said catch basin curb box and said cover member.

* * * * *